US005870791A

United States Patent [19]

Gurstein et al.

[11] Patent Number: 5,870,791

[45] Date of Patent: Feb. 16, 1999

[54] AIR COOLED FLOOR POLISHING MACHINE

[75] Inventors: Russell Gurstein, Hayden, Id.; Richard Westlake, Hillsboro, Oreg.; Glenn Moffitt, Spokane, Wash.

[73] Assignee: U.S. Products Inc., Hayden Lake, Id.

[21] Appl. No.: 371,208

[22] Filed: Jan. 11, 1995

Related U.S. Application Data

[63] Continuation-in-part of Ser. No. 897,170, Jun. 11, 1992, abandoned.

[51] Int. Cl.[6] ..... A47L 11/162

[52] U.S. Cl. ..... 15/98; 15/49.1; 451/353

[58] Field of Search ..... 15/98, 49.1, 50.1, 15/180, 385; 310/50, 53, 58, 59, 63; 451/353, 177, 259, 294, 350; 318/438, 729, 811

[56] References Cited

U.S. PATENT DOCUMENTS

| | | | |
|---|---|---|---|
| D. 296,252 | 6/1988 | Genovese | D32/19 |
| 1,988,193 | 1/1935 | Edstrom | 15/98 |
| 2,615,942 | 10/1952 | Edman | 310/63 |
| 3,921,244 | 11/1975 | Warren et al. | 15/49.1 |
| 3,931,659 | 1/1976 | Pfefferkorn et al. | 15/49.1 |
| 4,010,507 | 3/1977 | Johnson | 15/49.1 |
| 4,094,034 | 6/1978 | Wilkins et al. | 15/49.1 |
| 4,115,890 | 9/1978 | Burgoon | 15/49.1 |
| 4,118,819 | 10/1978 | Gordon et al. | 15/49.1 |
| 4,122,576 | 10/1978 | Bevington et al. | 15/49.1 |
| 4,150,456 | 4/1979 | Alvarez et al. | 15/49.1 |
| 4,218,798 | 8/1980 | Block | 15/49.1 |
| 4,219,898 | 9/1980 | Presby | 15/49.1 |
| 4,237,571 | 12/1980 | Nelson | 15/49.1 |
| 4,330,897 | 5/1982 | Tucker et al. | 15/246 |
| 4,358,868 | 11/1982 | Cook, Jr. | 15/49.1 |
| 4,365,377 | 12/1982 | Todd et al. | 15/49.1 |
| 4,393,534 | 7/1983 | Lee et al. | 15/98 |
| 4,400,843 | 8/1983 | Blomgren | 15/49.1 |
| 4,435,870 | 3/1984 | Tucker et al. | 15/50.1 |
| 4,443,906 | 4/1984 | Tucker et al. | 15/50.1 |
| 4,542,551 | 9/1985 | Phillips | 15/49.1 |
| 4,590,635 | 5/1986 | Tucker et al. | 15/50.1 |
| 4,608,727 | 9/1986 | Schwab | 15/98 |
| 4,658,459 | 4/1987 | Wood | 15/49.1 |
| 4,674,142 | 6/1987 | Meili | 15/49.1 |
| 4,675,042 | 6/1987 | Taddei-Contreras et al. | 65/158 |
| 4,742,652 | 5/1988 | Cannan et al. | 15/49.1 |
| 4,756,042 | 7/1988 | Genovese et al. | 15/49.1 |
| 4,783,872 | 11/1988 | Burhoe | 15/98 |
| 4,788,737 | 12/1988 | Kraus | 15/49.1 |
| 4,805,258 | 2/1989 | Sitarski et al. | 15/49.1 |
| 4,845,798 | 7/1989 | Genovese | 15/98 |
| 4,910,824 | 3/1990 | Nagayama et al. | 15/98 |
| 4,914,773 | 4/1990 | Ham | 15/49.1 |
| 4,947,503 | 8/1990 | Legatt | 15/49.1 |
| 4,963,778 | 10/1990 | Jensen et al. | 310/63 |
| 5,004,944 | 4/1991 | Fisher | 310/266 |
| 5,181,291 | 1/1993 | Fairheart | 15/98 |

FOREIGN PATENT DOCUMENTS

| | | | |
|---|---|---|---|
| 9010415 | 9/1990 | WIPO | 15/49.1 |

*Primary Examiner*—Gary K. Graham
*Attorney, Agent, or Firm*—Browdy & Neimark

[57] ABSTRACT

A light-weight, high-speed, electrically powered manually directed floor polisher for cleaning and polishing a floor, the polisher having a carriage on which is mounted wheels, a motor, an electronic motor controller means for providing the current and voltage to operate the motor, cooling means for cooling the motor and its controller, the controller including a power factor correction device, a polishing pad, means engaged to the polishing pad and the brushless D.C. motor for rotating the polishing pad, the polishing pad fixed on the carriage so that substantially the entire area of its polishing face is in contact with the surface during operation of the polisher, and a detachable free-floating handle rotatably mounted to the carriage to direct transport of the polisher when in operation. The motor is mounted on the carriage to operate the polisher and to place a constant percentage of the force produced by the weight of the polisher down through the polishing pad to maintain substantially the entire area of the polishing face in polishing contact with the floor being serviced during operation while the remainder of the force is transmitted down through the wheels.

20 Claims, 4 Drawing Sheets

AIR COOLED FLOOR POLISHING MACHINE

This application is a continuation-in-part of U.S. Ser. No. 07/897,170, filed Jun. 11, 1992, now abandoned, the contents of which is entirely incorporated herein by reference.

BACKGROUND OF THE INVENTION

1. Field of the Invention

The present invention relates to electrical floor polishing devices for commercial and residential use.

2. Description of the Prior Art

Many types of electrically powered floor polishing machinery have been and are presently sold in the marketplace.

The first conventional floor polishing machines, which were called "swing" machines, were very heavy and very slow. They weighed between 100 and 150 lbs. and were very difficult to transport. They generally consisted of a large D.C. rectified permanent magnet motor or a large A.C. motor mounted directly above the center of gravity of the machine. Since these machines had no wheels to support the weight of the machine while it was in operation, the total weight of the machine was transmitted to the floor through the polishing pad. Consequently, the polishing pad turned very slowly at approximately 175 rpm.

Since the "swing" machines had no supporting wheels, they were propelled over the floor by moving a handle rigidly engaged to the machine's housing up or down to swing the machine from left to right or right to left. This method of propelling the machine over the floor always required a skilled operator. Propelling the machine was complicated by the fact that the operator also needed to be proficient in removing old floor finish as well as polishing fresh floor finish. Pressure to complete jobs faster resulted in these machines reaching maximum speeds of between 300 to 400 rpm.

Increasing concern for more speed and facilitated operation resulted in a new class of divided weight machines. These machines are generally belt driven, use a set of wheels to support the motor and have a pad driving assembly which can rotate the polishing pad at between 900 to 1500 rpm. Conventionally, the pad housing is in front of the machine, the wheels are in the center of the machine and the motor is in the rear to counterbalance the pad, using the wheels as a pivot point. Conventionally, a handle is fixed to the polisher frame on housing behind these wheels. In operation, the fixed handle is used to enable continuous adjustable rotation of the pad and motor, as a counter balance, around the wheels as a pivot point to achieve maximum pad contact without overloading the motor.

Some examples of the divided weight machines are shown in U.S. Pat. No. 4,122,576 to Bevington et al. and in U.S. Pat. No. 4,756,042 to Genovese et al. These machines are an improvement over prior art "swing" machines as they can be pushed in a straight line like a lawnmower on the wheels provided.

Generally, the buffing surface of the pad defines a plane which is not tangent to the mounting wheels at their intersection with the floor surface. Consequently, with structures such as this, only a portion of the pad engages the floor. Placing the polishing pad at an angle to reduce amperage draw on a divided weight machine is shown in U.S. Pat. No. 4,122,576 cited above.

Attempts have been made to effect and maintain full pad contact with the floor by positioning the pad so that its surface does define a plane which is tangent to the mounting wheels at their intersection with the floor. However, with the operator handle generally disposed at a fixed angular relationship to the horizontal, a pushing motion upon the handle in a forward direction causes the rearward edge of the pad to be lifted from the floor, to some extent, until the inertia of the machine is overcome.

Attempts have been made to solve this problem by providing a handle which is pivotally mounted for movement about an axis on which the mounting wheels rotate. As the operator applies force to the machine by pushing it in a forward direction, some of the force is attenuated by the handle pivoting about the axis, and not as great a tilting movement is imparted to the buffing pad. Consequently, a greater percentage of the pad's surface will stay engaged with the floor than would if the handle was mounted at a fixed angle. An example of this type of machine is shown in U.S. Pat. No. 4,115,890 to Burgoon.

In all of the structures heretofore described, however, disengagement of at least a portion of the pad will always occur, at least for a short period of time, to one degree or another.

Whether an angle is purposely placed on a rapidly rotating disc or when propelling the machine forward, problems are created. When the extra pressure of an angled pad is placed on the front of the machine, the machine torques very hard to the right or to the left depending on which way the pad is turning. When the extra pressure falls either to the right or to the left side of the machine, it will buff bright one side and dull on the other. This, of course, makes use of the full potential of these machines impossible.

An additional improvement to divided weight machines, is found in U.S. Pat. No. 4,358,868 to Cook. As the polishing pad in contact with the floor becomes thinner due to wear, the increased angle on the pad causes increased torque and polishing problems of the type identified above. U.S. Pat. No. 4,358,868 addresses this problem by providing a mechanical device that manually raises and lowers the angle of the machine frame by moving the wheels up and down in slots placed in the frame. Accordingly, as the pad grows thinner from use, the angle could be compensated by the turning of a knob. While this device partly corrected some of the problems of divided weight machines, it clearly does not address the inherent problems identified above.

U.S. Pat. No. 4,365,377 to Todd et al. responds to the problems presented by divided weight machines by providing a third support in the form of a caster as a supplement to the wheels. The caster is located at the center of the polishing pad. In this way, the invention intends to permit full pad surface engagement. However, since the caster is spring-biased, any unevenness encountered by the caster in the floor results in uneven distribution of the weight of the machine to pad. Indeed, a deep indentation in the floor would result in a severe amperage draw which would overheat the motor.

The problems with all conventional divided weight machines can be attributed to the state of motor technology at the time of their concept. These motors were generally heavy, weighed between 30 to 60 lbs. and rated at 1½ H.P. with an efficiency rating below 85%. These characteristics barely permitted machines using such motors from performing the tasks required. To compensate for these motor features, the divided weight machines are all designed to take weight off the polishing pad to avoid motor slow-down and the drawing of more amperage which hampered the polisher's effectiveness.

It is to these deficiencies in the art that the invention, in accordance with the present application, is directed. It provides a combination of structural elements including the use of new brushless D.C. motor technology and features which permits the machine, as it is propelled forward, to eliminate any lifting of the polishing pad around the wheels while maximizing full engagement of the buffing or polishing surface of the pad with the floor.

SUMMARY OF THE INVENTION

The present invention is a combination of structural elements and features for facilitating full pad surface engagement of the treating pad of a floor treating machine with a floor surface.

Generally, the high-speed floor treating and/or polishing machine of this invention comprises: (A) a carriage upon which is mounted at least two spaced anti-friction supports such as skids, rollers, or wheels, which continuously contact the floor to support the machine; (B) a free-floating guiding handle extending rearwardly and rotatable on the carriage; (C) a brushless D.C. electric motor or other light-weight motor for rotating a floor contacting means, which motor is mounted on the carriage and which includes gearing between the motor and floor contacting means; (D) electronic motor controller means for providing the current and voltage to operate the brushless D.C. or possible other light weight motor mounted on the carriage; (E) the controller means including power factor correction means for more efficient use of current drawn from a conventional wall outlet receptacle; and (F) a polishing pad extending forwardly of the wheels on the carriage, fully contacting the floor being serviced while rotating at a high speed.

In accordance with the invention, the full pad feature of the invention is accomplished by appropriate placement of a brushless D.C. or light weight motor and its electronic controller (which includes power factor correction means) on the carriage of the floor polisher so that the entire area of the polishing surface of the associated polishing pad is maintained in contact with the floor being serviced during operation of the polisher. This is achieved in part because brushless D.C. or light weight motors with power factor correction means can deliver the same required horsepower as prior art motors even though substantially lighter. For example, a brushless D.C. motor of the kind disclosed in U.S. Pat. No. 5,004,944 weighs just 10 lbs and can deliver between 1½ to 2½% H.P. with an efficiency of over 90% using standard 120 Volt, 15 Amp circuit. The equivalent prior art motor weighs between 30 to 60 pounds and operates at an efficiency below 85%. It is understood that the details of the brushless D.C. or other light weight motor are not part of this invention but are known from the prior art.

A brushless D.C. or other light weight motor having these characteristics permits placement of the motor on the polisher carriage so that a greater percentage of the polisher's total weight can be constantly transmitted through the polishing pad to the floor while the entire area of the polishing surface of the pad is contacting the floor during operation of the polisher. This results in the polishing pad polishing the floor at a constant pressure through out the pad and eliminates any need by the operator to shift the weight of the polisher to deliver a greater pressure to one part of the pad as in the prior art. This unique and novel combination of structural elements further results in polishing pads with diameters 20 inches or larger being driven at over 1000 rpm, while their entire polishing area is in contact with the floor being serviced at a constant pressure. Notwithstanding the increased rpm and surface contact of the polishing pad, the light weight of approximately 50 pounds of the machine results in less operator fatigue and increased maneuverability.

To further assure that the entire polishing area of the polishing pad remains in contact with the floor being serviced during operation of the polisher to deliver a constant pressure throughout the pad, the conventional fixed handle found in prior art divided weight machines has been eliminated in favor of a free floating handle rotatably engaged to the carriage of the polisher. This handle permits easier operator control of the polisher during operation as the constant weight distribution eliminates the need for the counterbalancing required in operating conventional divided weight machines and the possibility of partial lifting of the polishing pad off the floor being serviced or to deliver a greater pressure to one part of the pad as in U.S. Pat. No. 4,358,868. Further, the adjustability of the handle facilitates storage and transport of the machine while not in operation.

In order to assure continuous operation of the brushless D.C. or light weight motor under all working conditions, the carriage of the polisher has been constructed as a heat sink with cooling means to maintain the operation of the brushless D.C. or light weight motor and its controller (including the power factor correction means) within the required operating temperature range.

Further, the feature of including the bearings within the pulley engaged to the polishing pad of the polisher also decreases the overall height and weight of the machine so as to better permit full contact of the polishing pad with the floor.

It is, therefore, a principal object of the invention to provide a light-weight, high-speed floor polishing machine weighing approximately 50 pounds as generally described, driven by a brushless D.C. or other lightweight motor positioned on the carriage of said polisher to maintain a constant percentage of the total weight of the polishing machine on the polishing pad of the machine to keep the entire area of its polishing surface in contact with the floor and deliver a constant pressure to the floor throughout the pad.

Another object of the invention is to provide a high-speed floor polishing machine approximately 50 pounds as generally described with a free-floating rotatable handle to facilitate operation and storage of the polishing machine and eliminate creating pressure pressure on the polishing pad when propelling the machine with the handle.

Still another object of the invention is to provide an improved floor polishing machine as generally described having a heat sink and cooling means to maintain operation of the brushless D.C. or light weight motor and its controller within a required temperature operating range.

Yet still another object of the invention is to provide an improved floor polishing machine approximately 50 pounds as generally described having polishing pads 20 inches or larger in diameter and revolving at over 1000 rpm while its entire polishing face is in contact with the floor being serviced and is delivering a constant pressure to the floor throughout the pad when driven by a brushless D.C. or light weight motor.

Many other objects and advantages of the invention will be apparent from the following detailed description of a preferred embodiment thereof, reference being made to the accompanying drawings hereafter described.

DETAILED DESCRIPTION OF THE PREFERRED EMBODIMENT(S)

Figure 1:
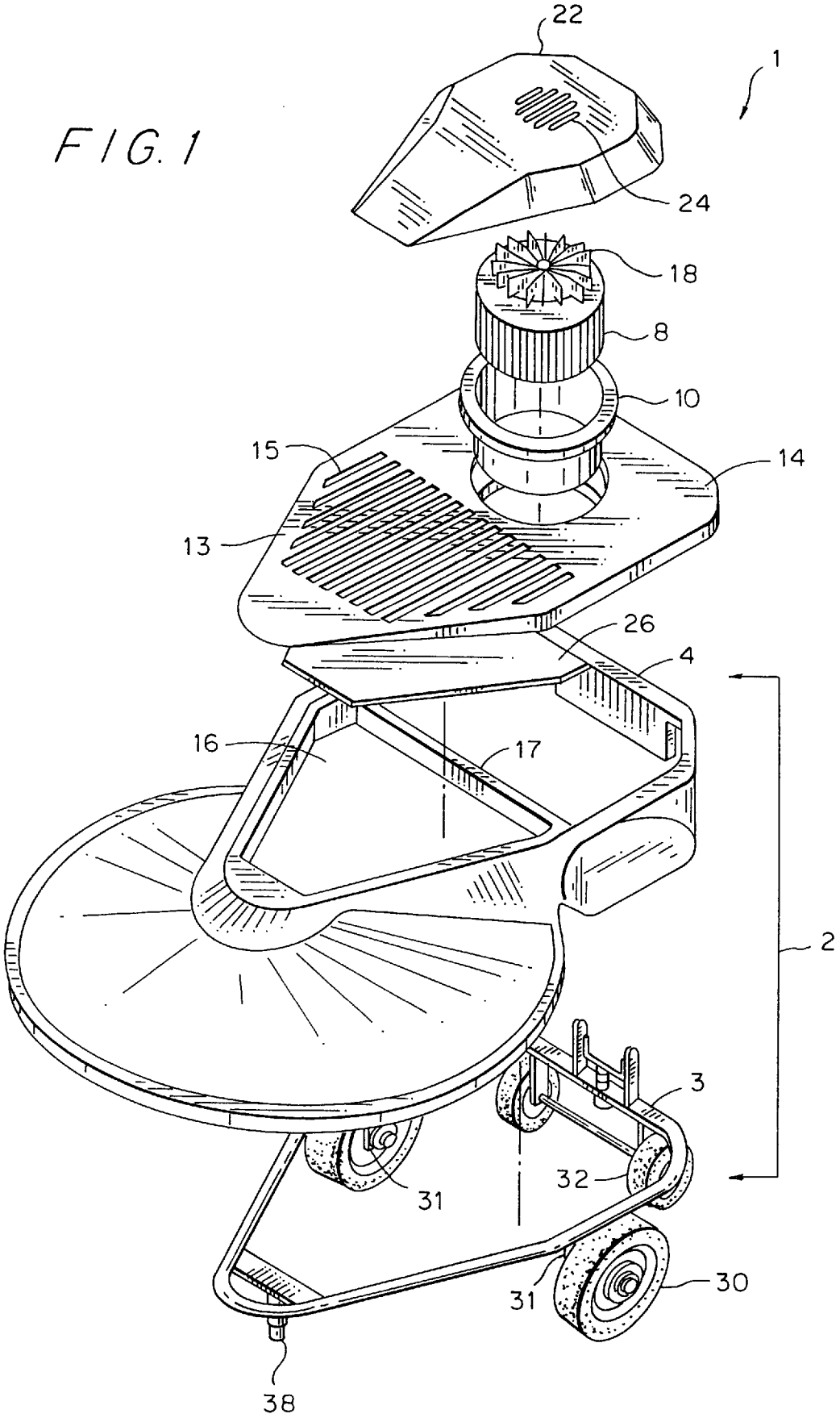
FIG. 1 is a perspective top exploded view of a floor polisher in accordance with the invention.
Figure 2:
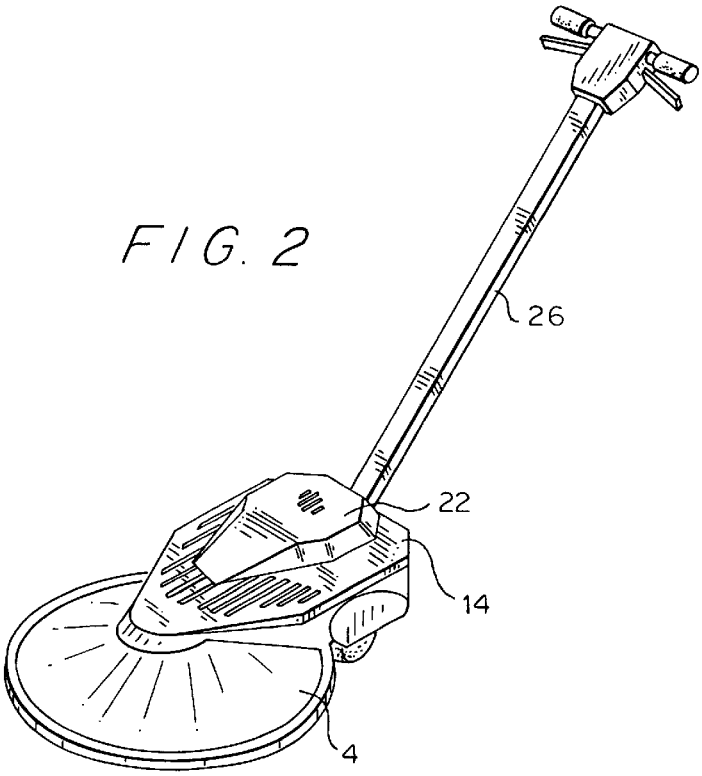
FIG. 2 is a perspective top view of a floor polisher in accordance with the invention.

FIGS. 1–5 of the drawings show floor polisher 1, in accordance with invention having a carriage 2 having a lightweight frame 3 which may be made from a structural material such as aluminum and a shroud 4 made from a plastic which is mounted on and over frame 3. Shroud 4 protects polishing pad 6 from above and the edges of pad 6 from collision damage.

As shown in the drawings, a brushless D.C. or other lightweight motor 8 which can deliver between 1½ to 2½ HP with an efficiency of over 90% using a standard 120 Volt, 15 Amp circuit, similar for example to the motor of U.S. Pat. No. 5,004,944, is mounted in a corresponding holding sleeve 10 which is engaged in opening 12 of an aluminum deck 14. Sleeve 10 is slightly tampered toward and along its longitudinal axis from its top to its bottom opening. Motor 8 is similarly tampered so that its insertion in sleeve 10 results in good engagement between motor 8 and sleeve 10. Motor 8 can also be bolted to sleeve 10 (not shown) for further stability. Aluminum deck 14 is produced to fit over opening 16 of housing 17 formed in shroud 4 and fastened to shroud 4. Aluminum deck 14 has fins 13 formed by cut out grooves 15 below the upper surface of deck 14 on its upper side to facilitate cooling as further discussed below. Motor 8 has a fan 18 fixed to the drive shaft 20 of motor 8. The fan 18 and motor 8 are protected from impact from above by a motor cover 22.

Motor cover 22 has air inlet 24 in the form of slots to facilitate cooling which is further discussed below. A detachable free-floating handle 26 is normally rotatable clockwise on frame 3 over approximately 180° during operation of floor polisher 1.

Figure 4:
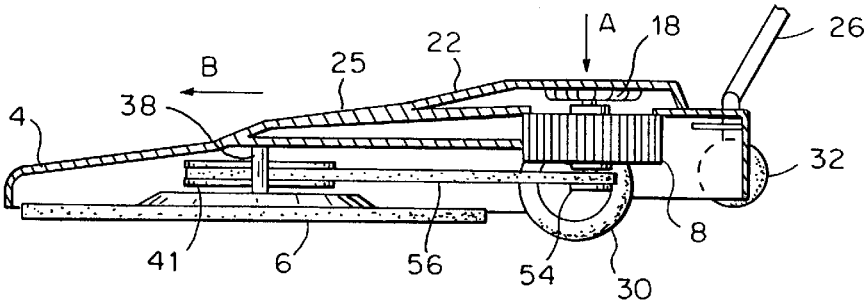
FIG. 4 is a sectional view taken along section line II–III.

FIG. 4 shows motor 18 assembled in corresponding sleeve 10 and mounted on deck 14 under motor cover 22. Cooling fan 18 is rotatable with the drive shaft 20 of motor 8.

Cooling fan 18 sucks air in through air inlet slots 24 and out under motor cover 22 through grooves 15, cooling both motor 8 and an upper surface of deck 14 while floor polisher 1 is in operation. The air flow is divided in two directions, along the top of deck 14 along grooves 15 under motor cover 22, and also straight down through cooling fan 18 through the fins of motor 8. The two directions of the air flow created by cooling fan 18 are shown by the arrows A and B in FIG. 3. This cooling feature facilitates the cooling of motor 8 and the motor controller 25 which includes power factor correction means mounted on the reverse side of deck 14. This cooling system is of primary importance to the operation of floor polisher 1, as failure to adequately cool the motor controller 25 serving brushless D.C. or light weight motor 8 will quickly result in burnout of the controller.

In an alternative embodiment not shown the cooling fan 18 can be located on shaft 20 between motor 8 and drive pulley 54 to provide the same cooling effect through grooves 15 and slots 24.

Figure 5:
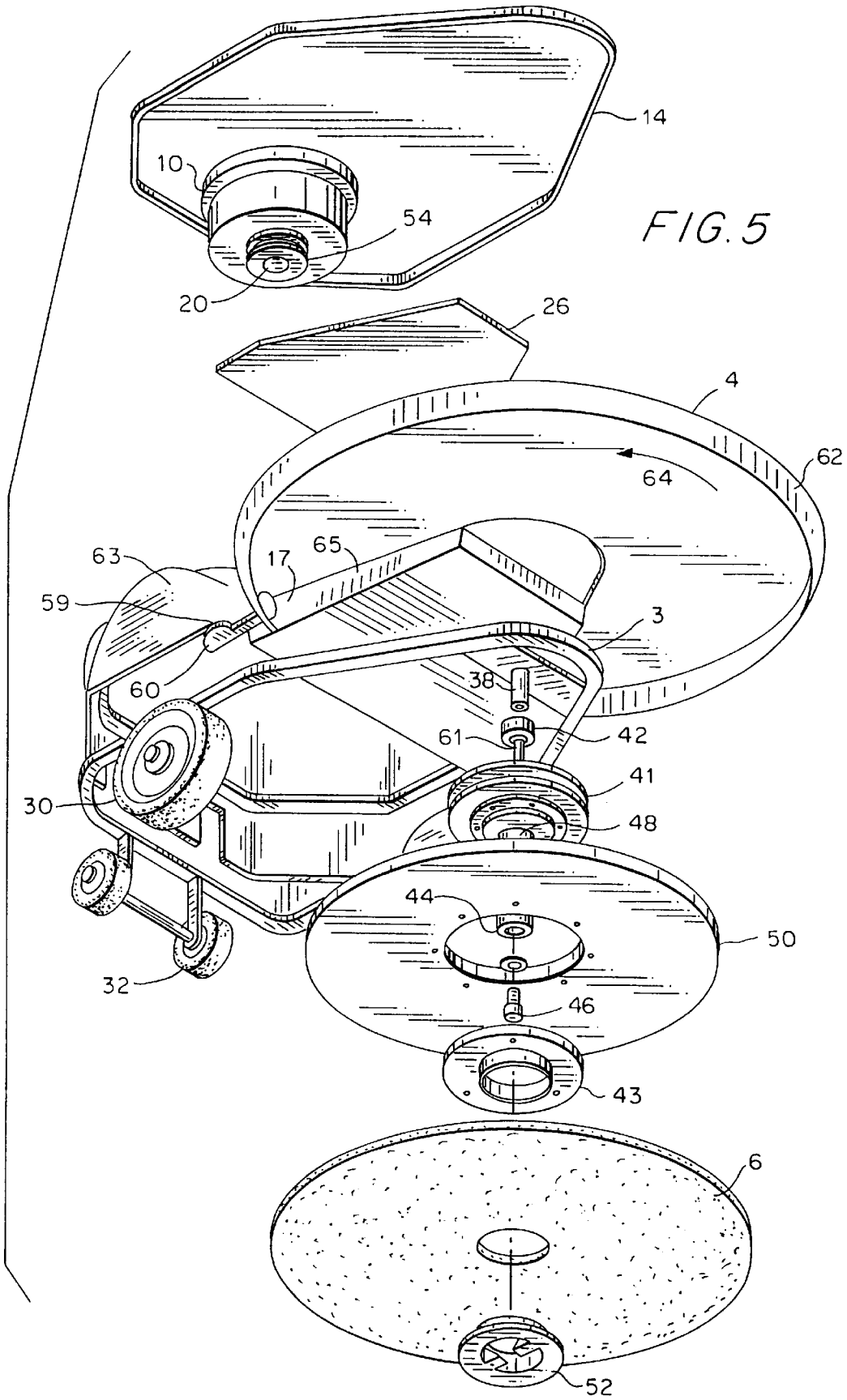
FIG. 5 is a perspective bottom exploded view of a floor polisher in accordance with the invention.

As best seen in FIGS. 1 and 5, the rear portion of frame 3 shows coaxial wheels 30 rotatably fixed to frame 3 on studs 31 to support and facilitate movement of the polisher on a floor being serviced when in operation.

Coaxial wheels 32 are also mounted on the rear portion of frame 3 to assist in moving the polisher when out of operation. Wheels 32 are located above the floor being serviced when the polisher is in operation.

Wheels 32 are used when the operator wishes to move floor polisher 1 when out of operation without having to overcome the friction of inoperative pad 6 in contact with the floor. This is accomplished by locking handle in an upright position (as further explained below) and then tilting the polisher 1 back on wheels 32 by rotating locked handle 16 around and off of wheels 30 onto wheels 32. When the polisher is supported by wheels 32, inoperative polishing pad 6 and wheels 30 are off the floor, thereby facilitating transport of floor polisher 1 on wheels 32.

Figure 3:
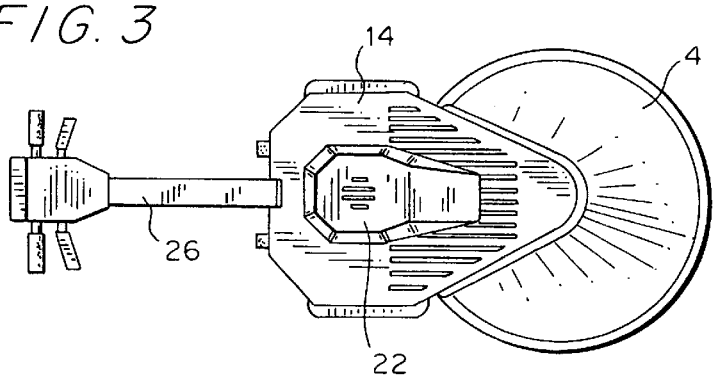
FIG. 3 is a top view of a floor polisher in accordance with the invention.

FIGS. 3 and 4 also schematically show the location of electronic motor controller means 25 below the under side of deck 14 in housing 17 which serves as the polishers electronic containment area. Controller means 25 is provided with power factor correction means for use with motor 8. Using power factor correction means with polisher 1 results in more useful power being developed while remaining within the power ratings of normal wall outlet receptacles. The result is a polisher which can complete the job more quickly using less power and operator time or a lighter motor.

Wile, power factor correction is not a new idea in and of itself, it has not been applied to enhancing the performance, improving cost effectiveness, and reducing the weight of floor care equipment. Further, electronic motor controller means are conventional in the art and not a novel feature of the invention. Therefore, the controller is shown only schematically as its details including the power factor correction means are well known to the artisan skilled in the art. However, as already noted, the placement of controller 25 in a position where it is adequately cooled while it serves brushless D.C. or light weight motor 8 is a primary feature of the floor polisher in accordance with the invention. As shown controller 25 is completely protected in the containment area of housing 17 from contamination and impacts off the floor.

FIG. 4 further shows that the front portion of frame 3 has bearing shaft 38 pointing straight down on which pulley 41 is mounted through a pair of bearings 42, 44 housed within pulley 40. The bearings (42, 44) carrying pulley 41 are engaged to pulley 41 and to shaft 38 by bolt 46 within cylindrical opening 48 on pulley 41.

A flexible plastic pad holder 50*d* collar 43 shown in FIG. 5, is engaged to pulley 41 by screws (not shown) to support the upper face of polishing pad 6. Polishing pad 6 is rotatably mounted and secured by pad retainer 52 to pad holder 50 and pulley 41 so that the full polishing face of the pad is in direct contact with the floor being serviced. Thus, bearings 42, 44 are mounted into pulley 41 and polishing pad holder 50 mounted to pulley 41 to make a complete unit. This feature assists in eliminating over 50% of the weight and height of conventional machines and does away with the need for a third wheel to keep extra weight off polishing pad 6.

Polishing pad 6, which preferably has a diameter of 20 inches or more, is driven off of drive pulley 54 and belt 56 by motor 8 as shown in FIG. 3, with the full polishing face of the pad in contact with the floor. This is assured by locating motor 8 on frame 3 so that the constant percentage of the force produced by the weight of the motor 8, necessary to maintain such contact, bears directly down through pad 6.

Shroud 4 can be fastened on the front portion of frame 3 by fastening bolts (not shown). Shroud 4 protects polishing pad 6 on the assembled polisher. Shroud 4 is easily removed from frame 3 to facilitate simple maintenance by removal of the fastening bolts. The shroud 4 also contributes to the light weight of floor polisher 1 in addition to functioning as a very rigid bumper.

As shown in FIG. 5, two channels 59, 61 are formed on the underside of shroud 4 between outerwall 63 and housing wall 65. As shown in FIG. 5, a filter 60 is fastened to the underside of shroud 4 in channel 59 while channel 61 is left unobstructed. When pad 6 rotates in a clockwise direction when polisher 1 is operating air flow through channel 61 and debris under shroud 4 flow in the direction of arrow 64 into filter 60 leaving debris in filter 60 and allowing air to pass through. To facilitate debris collection and movement of polisher 1 over the floor being polished the lower portion of edge 62 of shroud 4 can be made of felt.

Figure 6:
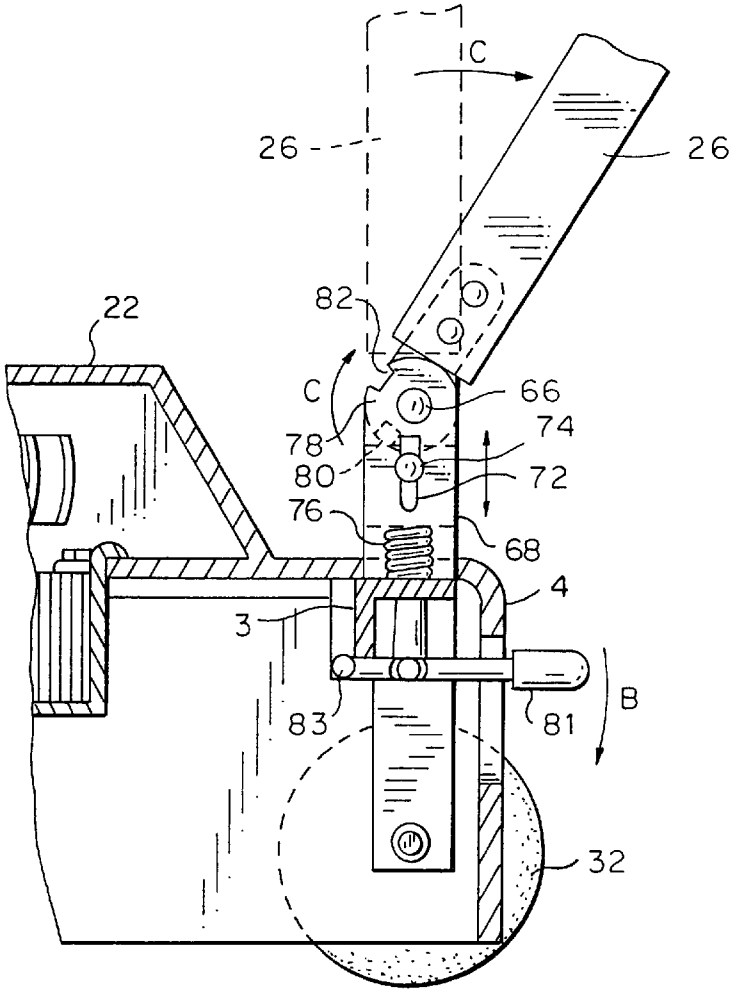
FIG. 6 is a partial vertical cross-sectional view of the handle as it is engaged to the frame.

As indicated above, circular end 78 of handle 26 is generally rotatable as shown in FIG. 6 when floor polisher 1 is in operation. However, when the floor polisher is not in operation and it is desirable to move the polisher without having to overcome the friction of polishing pad 6 in contact with the floor, it is necessary to lock handle 26 in an upright position as shown in dashed lines in FIG. 6. This permits tilting polisher 1 back onto wheels 32 by rotating locked handle 26 around and off of wheels 35 onto wheels 32. As noted, in this position wheel 32 and pad 6 are off the floor and permit the polisher to be moved on wheels 30.

Figure 7:
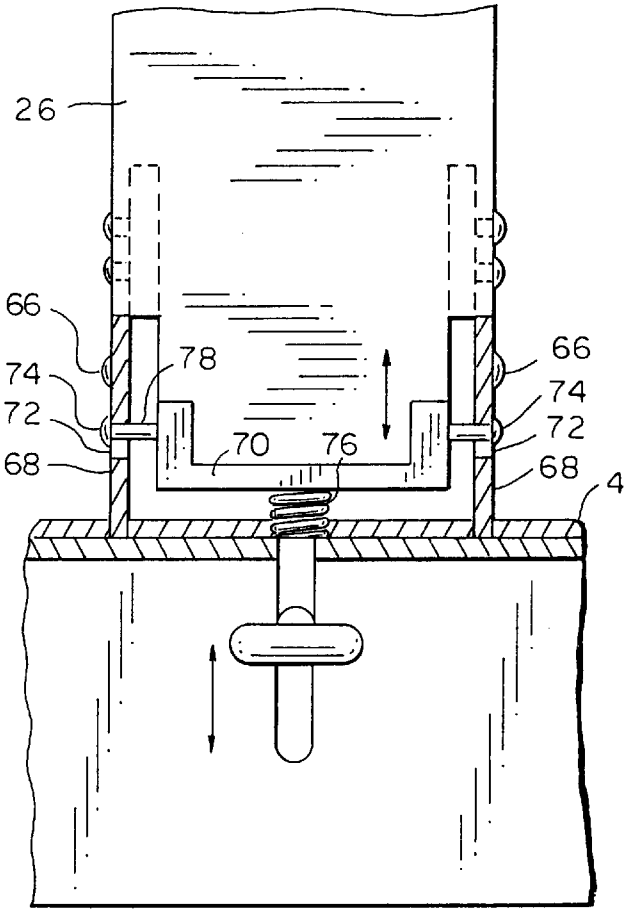
FIG. 7 is a view of the handle of FIG. 6 taken along line VI—VI.

FIGS. 6 and 7 show the mechanism provided to permit the locking of handle 26 in an upright position and its release for rotation on frame 3.

As shown, handle 26 is rotatable around pivot pins 66 engaged on upright posts 68 of frame 3. U-shaped catch member 70 is slidably mounted in slots 72 in upright posts 68 by projection pins 74. Catch member 70 is spring biased upward from frame 3 by spring 76.

When handle 26 is free floating the circumference of circular end 78 of handle 26 rides on the outer surface of projection pins 74. However, when handle 26 is moved to an upright position as shown by dashed lines in FIG. 6, projection pins 74 are biased by spring 76 into indent 80 on circular end 78 of handle 26. This locks handle 26 in the upright position, as shown by FIG. 6.

When the operator wishes to release handle 26) from its locked position shown in FIG. 6, it is only necessary to move pedal 81 clockwise around pivot pin 83 as shown by the arrow B in FIG. 6 to disengage pins 74 from indent 80 and then rotate handle 26 in a clockwise direction as shown by the arrow C. After pins 74 have cleared indent 80, handle 26 is free to rotate on frame 3 through the arc length of approximately 180°.

When the operator wishes to again lock handle 26 in its upright position, it is only necessary to rotate handle 26 counterclockwise until pins 74 engage indent 80.

Indent 82 is provided to permit handle 26 to be locked adjacent to cover 22 in a compact storage position when handle 26 is rotated approximately 90° in a counterclockwise direction.

The above described lightweight floor polisher is aimed at providing a machine which weighs less than currently used floor polishers, while permitting full contact of the polishing face with the floor being serviced, when using pads with diameters of 20 inches or more, while being rotated at a higher rpm than conventional machines. Notwithstanding, this increased surface contact of the polishing face, the light weight of the machine and its weight distribution result in less operator fatigue and increased maneuverability.

The foregoing description of the specific embodiments will so fully reveal the general nature of the invention that others can, by applying current knowledge, readily modify and/or adapt for various applications such specific embodiments without departing from the generic concept, and, therefore, such adaptations and modifications should and are intended to be comprehended within the meaning and range of equivalents of the disclosed embodiments. It is to be understood that the phraseology or terminology employed herein is for the purpose of description and not of limitation.

What is claimed is:

1. A light-weight, high-speed, electrically powered manually directed floor polisher for cleaning and polishing a surface, said polisher comprising:

a carriage, at least two coaxial wheels each rotatably mounted on an axle fixed to said carriage for transporting said polisher on said surface, an electrically powered motor fixed on said carriage, an electronic motor controller means fixed on said carriage for controlling the current and voltage to operate said motor, wherein said electronic controller means includes power factor correction means for more efficient use of current drawn from a conventional wall outlet receptacle, air cooling means fixed on said carriage for air cooling said motor and said controller means during operation of said polisher, a polishing pad rotatably mounted on said carriage, pulley means engaged to said polishing pad and said motor for rotating said polishing pad during operation, a polishing face on one side of said polishing pad, said polishing pad rotatably mounted on said carriage so that substantially an entire area of said polishing face is in contact with said surface at a constant pressure during continuous operation, a detachable free floating handle mounted to said carriage and rotatable during said continuous operation to direct transport of said polisher, wherein, said motor is fixed on said carriage over said two coaxial wheels to operate said polisher and to place a constant percentage of a force produced by the weight of said polisher down through said polishing pad to said surface to maintain said substantially entire area of said polishing face in continuous polishing contact with said surface at a constant pressure when said polishing pad is rotating while a constant remainder of said force is transmitted down through said at least two coaxial wheels.

2. The polisher in accordance with claim 1, wherein over a fifty percent of the force produced by the weight of said polisher is transmitted down through said polishing pad while the remainder of said force is transmitted through said at least two coaxial wheels during operation.

3. The polisher in accordance with claim 1, wherein said carriage has a frame made of an aluminum alloy.

4. The polisher in accordance with claim 1, wherein said carriage further comprises:

a shroud detachably engaged to a periphery of a frame and extending over a portion of said polishing pad exposed past said periphery of said frame.

5. The polisher in accordance with claim 4, wherein said shroud is made from plastic.

6. The polisher in accordance with claim 4, wherein, said electronic motor controller means for operating said motor is located in a housing on an upperside of said shroud, said housing being covered with a deck having grooves on an upperside thereof.

7. The polisher in accordance with claim 6, wherein said air cooling means comprises:

said motor being mounted on said shroud, a fan engaged to the drive shaft of said motor, a cover mounted on the upperside of said deck, said cover having air inlet slots, wherein, during operation, said fan draws air through said air inlet slots cover and said grooves of said deck over said motor and said housing for said electronic motor controller.

8. The polisher in accordance with claim 7, wherein a second pair of coaxial wheels is rotatably mounted to said frame, said second pair of wheels located above and out of contact with said surface during operation of said polisher, locking means on said free floating handle and said frame for rigidly engaging said handle in an upright position, wherein, said handle is rigidly engaged to said frame by said locking means to permit tilting of said polisher back onto said second pair of wheels for transporting said polisher when out of operation.

9. The polisher in accordance with claim 1, where the total weight of said polisher is approximately 50 pounds and said motor produces between 1½ and 2½ horsepower.

10. The polisher in accordance with claim 1, wherein said polishing pad has a diameter of 20 at least inches.

11. The polisher in accordance with claim 10, wherein, when said polishing pad operates at over 1,000 rpm, said percentage of said force produced by the weight of said polisher is transmitted to said polishing pad to maintain said entire area of said polishing face in contact with said surface at a constant pressure.

12. The polisher in accordance with claim 1, wherein said motor is driven by current delivered through a cord engaged between said motor and an electric outlet.

13. The polisher in accordance with claim 1, wherein said pulley means comprises a pulley shaft integrally engaged to said frame;

a first pulley mounted on said pulley shaft through bearings housed within said first pulley;

a second pulley mounted on said drive shaft; and a pulley belt engaged around said first pulley and said second pulley.

14. An electrically powered manually directed floor polisher for cleaning and polishing a surface, said polisher comprising:

a carriage having, at least two coaxial wheels each non-adjustably and rotatably mounted on an axle fixed to said carriage for transporting said polisher on said surface, an electrically powered motor mounted on said carriage, power factor correction means on said carriage and electrically connected to the motor for more efficient use of current drawn from a conventional wall outlet receptacle and producing a required horsepower from the motor, a polishing pad mounted on said carriage, pulley means engaged to said polishing pad and said motor for rotating said polishing pad during operation, a polishing face on one side of said polishing pad, said polishing pad non-adjustably and rotatably mounted on said carriage so that substantially an entire area of said polishing face is in contact with said surface during continuous operation, wherein, said motor is mounted on said carriage over said two coaxial wheels to operate said polisher and to place a constant percentage of a force produced by the weight of said polisher down through said polishing pad to said surface to maintain said substantially entire area of said polishing face in continuous polishing contact with said surface when said polishing pad is rotating while a constant remainder of said force is transmitted down through said at least two coaxial wheels.

15. The floor polisher according to claim 14, further comprising a detachable free floating handle mounted to said carriage and rotatable during said continuous operation to direct transport of said polisher.

16. A polisher according to claim 14 wherein over a constant fifty percent of the force produced by the weight of said polisher is transmitted down through said polishing pad while the remainder of said force is transmitted through said support means during operation.

17. A polisher according to claim 14 wherein when said polishing pad operates at over 1,000 rpm, said percentage of the force produced by the weight of said polisher is transmitted to said polishing pad to maintain said entire area of the polishing face in contact with said surface.

18. A polisher according to claim 14 wherein a electronic motor controller means is located in a housing on the carriage of said polisher, said housing being covered with a deck having cut out grooves on an upperside thereof.

19. The floor polisher according to claim 14, wherein said two coaxial wheels are not vertically adjustable relative to the carriage.

20. The floor polisher according to claim 14, wherein said polishing pad is not adjustable relative to the carriage.

* * * * *